US005820185A

United States Patent [19]

Gomes

[11] Patent Number: 5,820,185

[45] Date of Patent: Oct. 13, 1998

[54] DEVICE FOR CARRYING CONTAINERS

[75] Inventor: Jean-Manuel Gomes, Rilhac Rancon, France

[73] Assignee: Riverwood International Corporation, Atlanta, Ga.

[21] Appl. No.: 720,821

[22] Filed: Oct. 2, 1996

[30] Foreign Application Priority Data

Oct. 4, 1995 [GB] United Kingdom ..... 9520274

[51] Int. Cl.[6] ..... B65D 71/00

[52] U.S. Cl. ..... 294/87.2; 206/147; 206/153

[58] Field of Search ..... 294/87.2, 87.26, 294/87.28, 159; 206/145, 147–149, 153, 158, 162, 168–170, 175, 194, 199, 200, 427, 429

[56] References Cited

U.S. PATENT DOCUMENTS

| | | | |
|---|---|---|---|
| 3,097,010 | 7/1963 | Silver | 294/87.2 |
| 3,860,281 | 1/1975 | Wood | 294/87.2 |
| 4,180,191 | 12/1979 | Wood | 294/87.2 |
| 4,244,617 | 1/1981 | Manizza | 294/87.2 |
| 4,318,476 | 3/1982 | Wood et al. | 294/87.2 X |
| 4,432,579 | 2/1984 | Denmark et al. | 294/87.2 |
| 5,273,156 | 12/1993 | Harris | 206/147 |
| 5,344,006 | 9/1994 | Mazzeo | 206/153 |
| 5,351,816 | 10/1994 | Sutherland et al. | 206/153 |

FOREIGN PATENT DOCUMENTS

| | | |
|---|---|---|
| 1454962 | 11/1965 | France . |
| 4433489 | 9/1994 | Germany . |
| 2038764 | 12/1979 | United Kingdom . |
| WO94/07760 | 10/1993 | WIPO . |

*Primary Examiner*—Johnny D. Cherry
*Attorney, Agent, or Firm*—Isaf, Vaughan & Kerr

[57] ABSTRACT

A paperboard carrier device for retaining a plurality of containers is disclosed. The carrier device is made from a paperboard blank (10) and has a base (16) with apertures defined therein for receiving the necks of the respective containers, two side walls (19,20) hingedly connected to opposed side edges of the base, the side walls being angled with respect to the base and extending toward one another, and two handle panels (23,24) hingedly connected to each one of the respective side walls. A plurality of reinforcing flaps (34) are defined in the side walls and the handle panels, the reinforcing flaps being hingedly attached to each one of the side walls along an edge (32), respectively. The reinforcing flaps are folded against the side walls in use, and have a length greater than half of the width of the base.

13 Claims, 4 Drawing Sheets

DEVICE FOR CARRYING CONTAINERS

BACKGROUND OF THE INVENTION

This invention relates to devices for carrying two or more containers, each having an annular shoulder. One particular but not exclusive application is in the carrying of bottles for beverages.

SUMMARY OF THE INVENTION

According to the present invention a carrier device is provided for carrying two or more containers each having an annular shoulder projecting from the neck portion, said carrier device being formed from paperboard and including a base having two or more apertures for receiving the respective neck portions of the containers, two side walls which are connected to the base by way of substantially parallel fold lines at opposite sides of the base and which are, in use, angled relative to the base and extend towards each other, a cut away portion being formed for each container in each side wall such that opposite side portions of an annular shoulder of a container are a snap fit between a cooperating pair of cut away portions, at least one reinforcing panel being provided for each bottle, each reinforcing panel being hingedly connected to the device, extending, in use, between the base and the cut away portion for that bottle, being disposed, in use, against a side wall and having a maximum length in the direction perpendicular to the fold lines between the base and the side walls which length is greater than half the width of the base between the fold lines with the side walls.

In one embodiment the reinforcing panel or panels for each container are cut from the base thereby to define at least in part the aperture for the bottle, the reinforcing panel or panels being hingedly connected at the junction of the base and the adjacent side wall. A further feature is that one reinforcing panel is provided for each container, said reinforcing panel, when folded into the aperture, having an edge opposite the hinge which edge extends fully across the aperture in a direction parallel to the hinges between the base and the side walls. In another arrangement two reinforcing panels are provided for each container, which reinforcing panels in use are disposed against respective side walls.

In another embodiment the reinforcing panel or panels for each container are cut from the device so as to define at least in part the cut away portions for said container, the or each reinforcing panel being hingedly connected to its associated side wall. Preferably two reinforcing panels are provided for each container, each reinforcing panel defining one cut out portion for each container.

A further preferred feature is that the active edge of each cut away portion is constituted by an edge generally parallel to the side wall/base junction which edge has generally upwardly angled end portions.

In further preferred arrangements the side walls are hingedly connected to upwardly projecting handle portions which incorporate a handle. Conveniently the cut away portions extend into the handle portions to accommodate the container caps. In addition the handle portions may be glued together immediately above the hinge line with the side walls. With some arrangements a further securing flap extends from one handle portion and is folded over the free edge of the other handle portion and adhesively secured thereto.

With some embodiments the handle is formed by cutting out slot-shaped elements which remain hingedly connected to the handle portion along an upper edge which is generally parallel to the hinge between the handle portions and the side walls. Preferably the handle aperture and cut out elements are located and dimensioned such that when in use the handle portions can be folded down so as to lie adjacent one side wall, the cut out elements being a snap fit below the annular shoulders of the containers.

Embodiments of the present invention will now be described in more detail.

DETAILED DESCRIPTION OF THE PREFERRED EMBODIMENT

Figure 1:
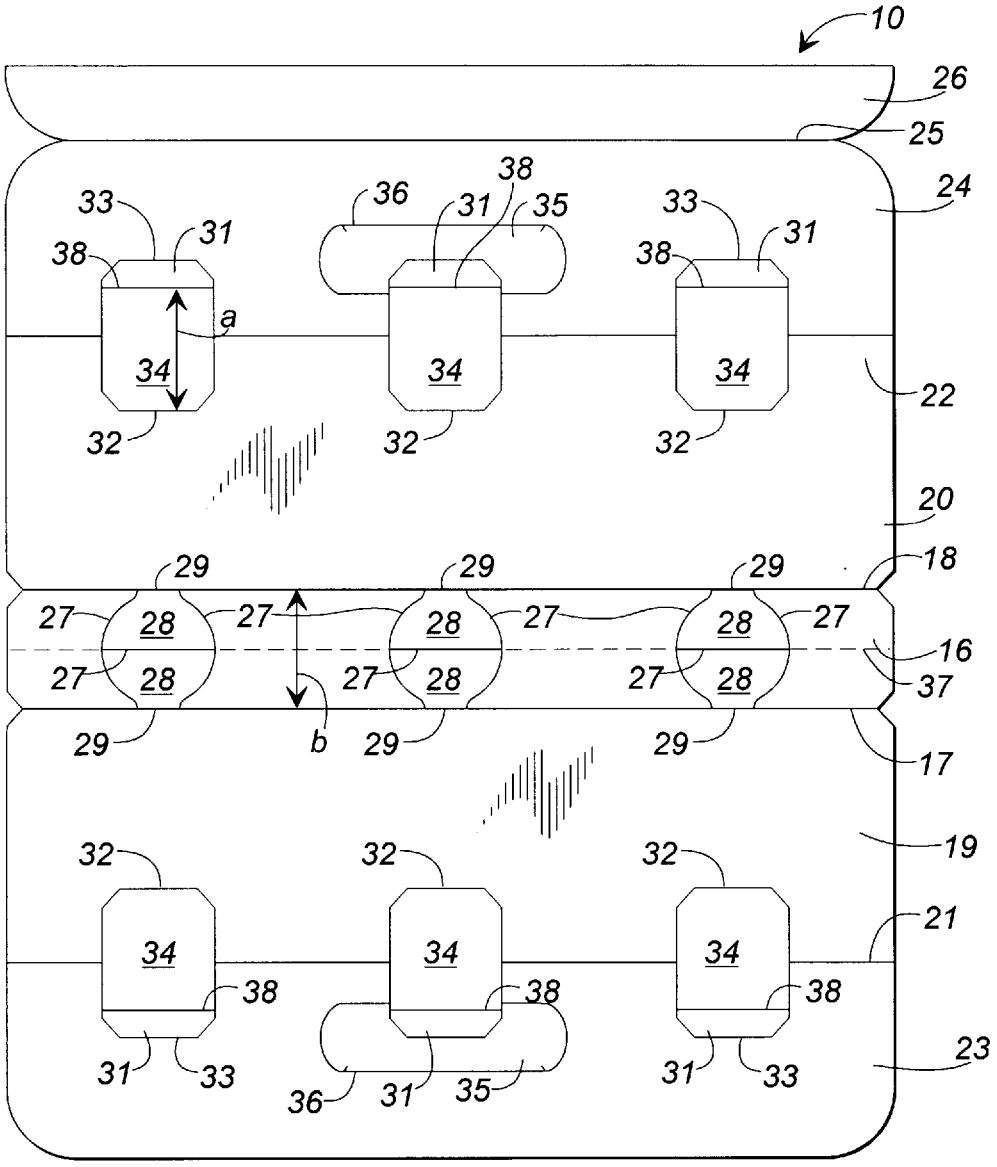
FIG. 1 shows a blank according to one aspect of the present invention.
Figure 2:
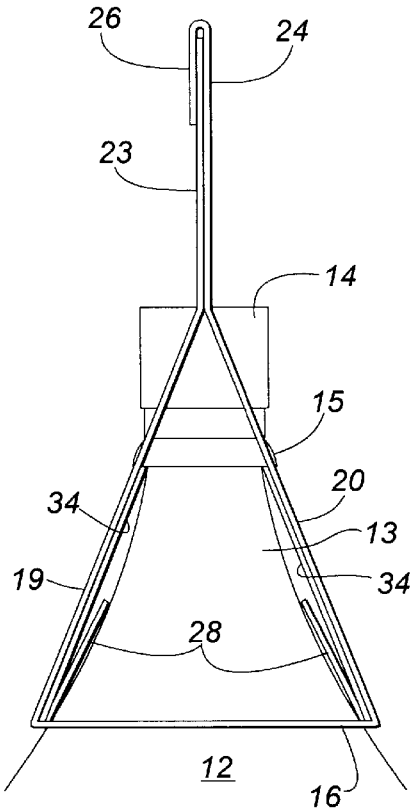
FIG. 2 is an end view of a carrier device formed from the FIG. 1 blank in use.
Figure 4:
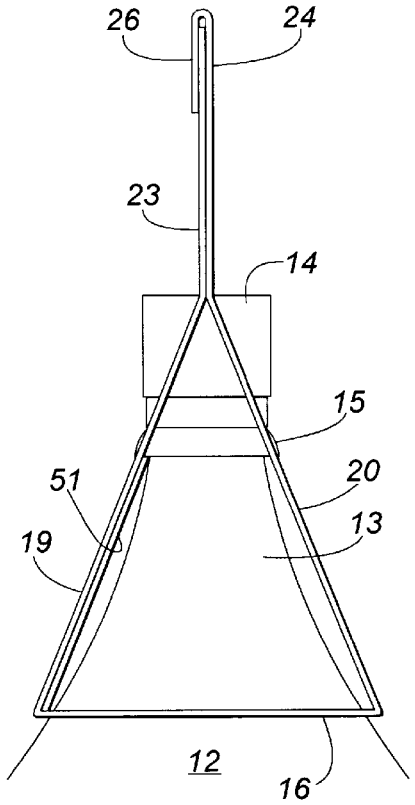
FIG. 4 is an end view of a carrier device formed from the FIG. 3 blank in use.

In FIG. 1 there is shown a paperboard blank 10 for producing the carrier device 11 shown in FIG. 2. The device 11 is for use in coupling together, in this embodiment, three bottles 12, each having a relatively long, thin neck compared to other types of bottle such as 2 liter PET beverage bottles. The device 11 enables three such bottles 12 to be carried as a multipack safely and conveniently. Each bottle 12 has a general neck portion 13, a closure 14 and an annular shoulder 15 just below the closure 14.

The device 11 is made from the paperboard blank 10 and has a base 16 which is hingedly connected at each side edge 17, 18 to a side wall 19, 20 which extend upwardly and towards each other. The side walls 19, 20 are in turn hingedly connected along fold lines 21, 22 to handle portions 23, 24. One handle portion 24 is hingedly connected along fold line 25 to a securing panel 26.

In the base 16 cuts 27 are made to define, in this embodiment, six flaps 28 which remain hingedly attached along fold lines 29 and which are generally semi-circular. When the flaps 28 are folded out of the plane of the base 16, generally circular apertures are defined in the base 16.

Cut away portions or holes 31 are also cut out of the blank 10, which holes span the fold lines 21, 22. The holes 31 are generally rectangular, although, optionally, the edges 32, 33 parallel to the fold lines 21, 22 have their ends angled slightly towards the fold line. The paperboard cut to make the holes is retained in the form of reinforcing flaps 34 which remain hingedly connected to the side walls 19, 20 at edges 32. The length a of each flap 34 is greater than half the width b between the side edges 17, 18.

Bordering on the upper edge 33 of the central holes are slot-like handle elements 35 which are cut from the blank 10, but which remain hingedly attached along fold lines 36. A central fold 37 is preferably provided extending lengthwise of the base.

To assemble the device 11 the two side walls 19, 20 are folded towards each other and a glue line is applied to one of the handle positions 23, 24 just above the respective fold lines 21, 22. Another glue line is applied remote from the fold line 21, 22 on either handle portion 23, 24. The handle portions 23, 24 are then stuck together such that fold lines 21, 22 lie next to each other. Glue is also applied to the panel 26 which is folded over and secured to the handle portion 23. The base 16 and side walls 19, 20 therefore form a triangular section attached to a double thickness handle section which has an extra reinforcing thickness (panel 26) above the handle fold lines 36. The fold 37 enables the device 11 to be stored flat when not in use.

The device 11 is applied to a series of three bottles 12 in a very simple manner. Examining the engagement of a single bottle 12 only, the reinforcing flaps 34 are hinged downwardly about the edges 32 so as to lie against the inside of the respective side walls 19, 20, so that the free edge 38 of the reinforcing flaps 34 engages in the angle between the base and the side walls. Alternatively the flaps 34 could be folded before the device is folded and glued. The device is then pushed downwardly over the neck area 13 of the bottles 12. The closure 14 of bottle 12 engages the pair of flaps 28 which are pushed upwards about fold lines 29. Further downward movement of the device 11 causes the shoulder 15 to engage the reinforcing flaps 34 and push past the upper edges of the flaps 28 and the edges 32 so as to be engaged by the device 11 by means of a snap action, the edges 32 engaging firmly below the shoulder 15.

The device is dimensioned such that the closure 14 is a neat fit in holes 31, the shoulder 15 is held firmly and the aperture 30 preferably sits on the upper portion of the bottle 12 below the shoulder 15. The reinforcing flaps serve to strengthen the side walls below the cut away portions 31.

The above described construction enables a reinforced carrier device 11, or bottle clip, to be used on slim necked bottles. This would not be possible with known bottle clips for such articles.

Figure 3:
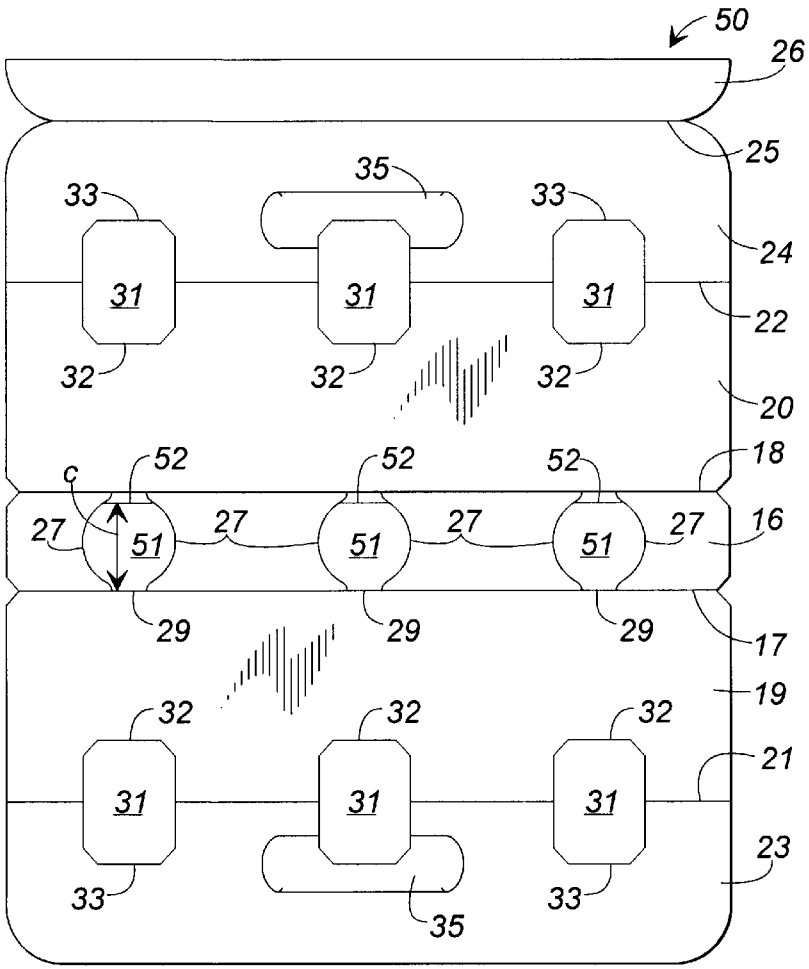
FIG. 3 shows a blank according to another aspect of the present invention.

In FIG. 3 there is shown an alternative blank 50. Many features of the blank 50 are similar to the blank 10 shown in FIG. 1 and so have been given like reference numerals. With blank 50 the reinforcing flaps 34 have been dispensed with, the holes 31 being wholly cut from the side walls 19, 20 and handle portions 23, 24. Instead, the apertures in the base 16 are cut such that there is one flap 51 which extends more than halfway across the width b between the side edges 17, 18 of the base 16, such that the height c of the flap is substantially equal to the distance between the edge 32 and the side edge 17.

The blank 50 is folded and glued in a similar manner to that described above in relation to the blank 10. When the device is pushed down on to a bottle 12, the flap 51 is hinged upwardly so as to lie against the side wall 19. The shoulder 15 of the bottle is then pushed past the edges 32 and the free edge 52 of the flap which lies adjacent one of the edges 32, said edges 32, 52 engaging below the shoulder with a snap fit. The device is, therefore, reinforced on one side of the bottle.

Figure 5A:
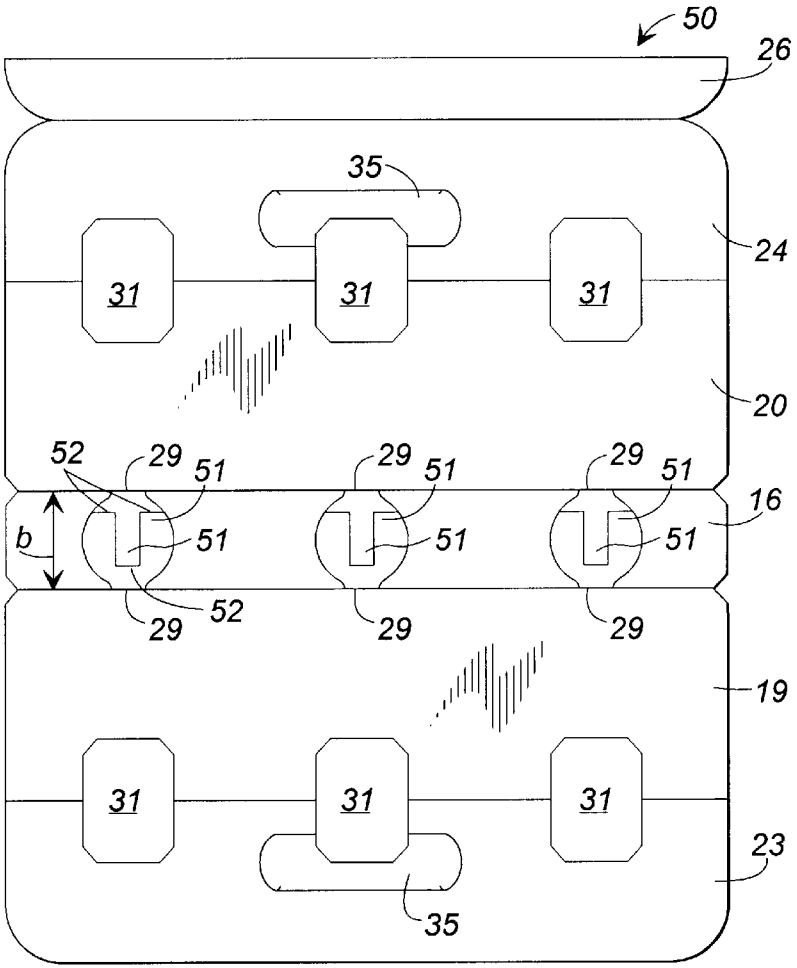
FIGS. 5A, 5B and 5C show further alternative blanks according to the present invention.
Figure 5C:
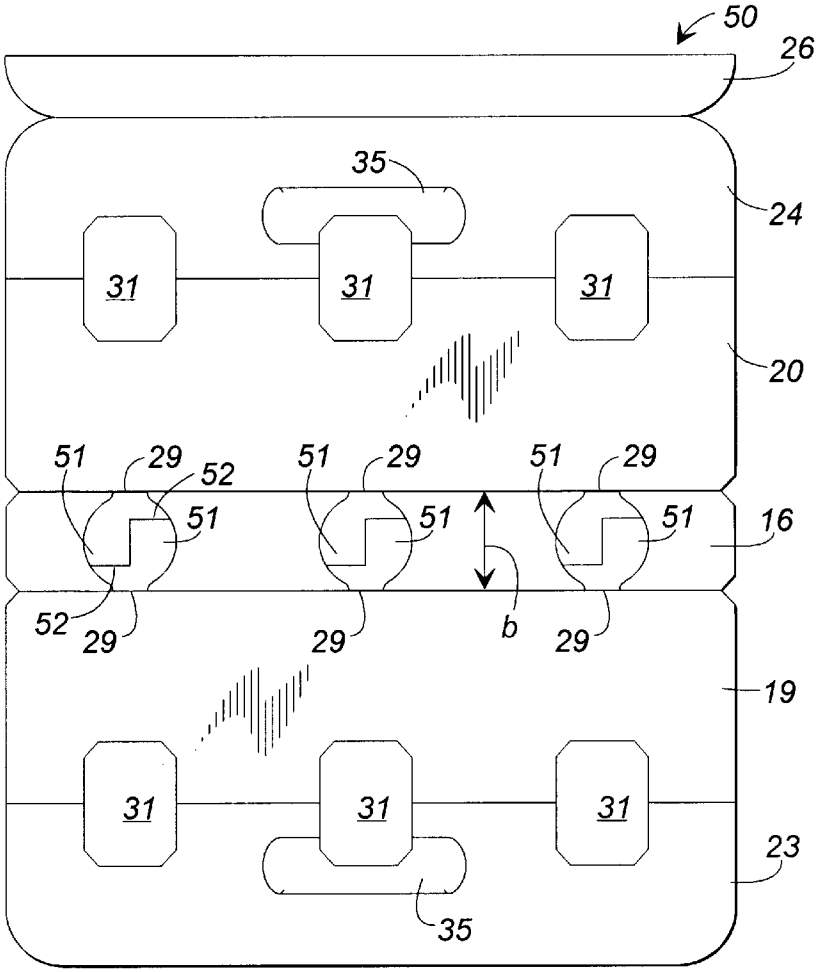
Figure 5B:
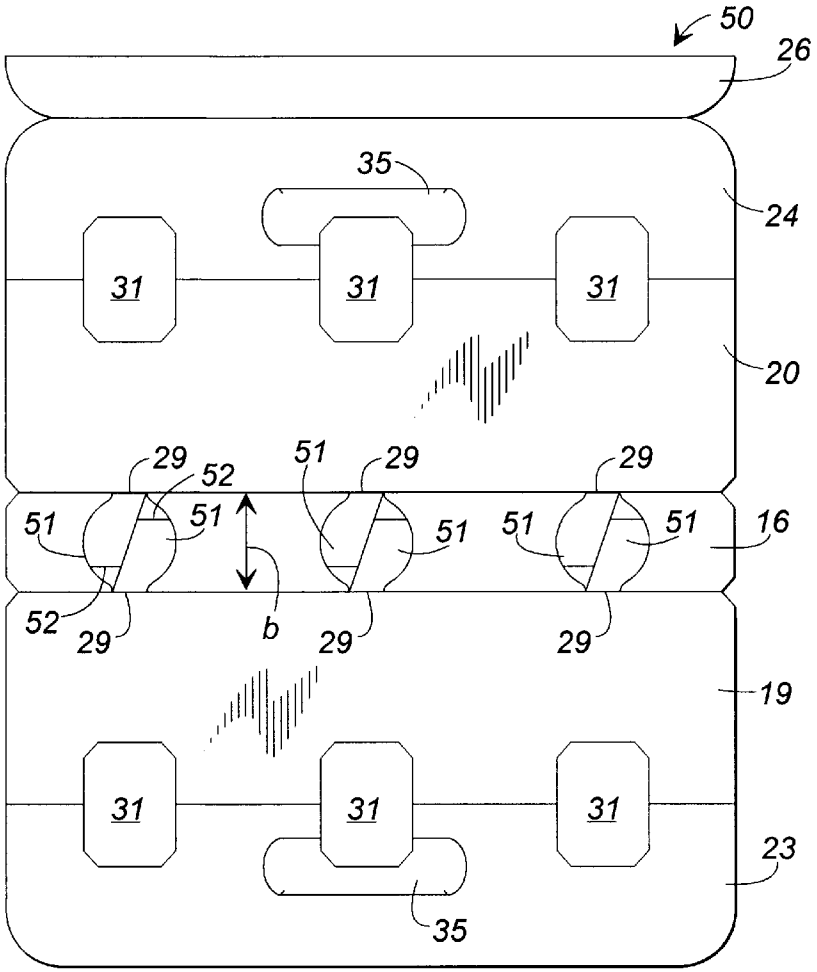

In FIGS. 5A, 5B, and 5C there are some examples of other blanks which have two reinforcement flaps 51 cut from the base 16 to form the apertures. In each case the maximum perpendicular distance from the side edges 17, 18 of the base to the free edge 52 of the flaps 51 is greater than half the width b of the base 16 and the free edges 52 engage at least in part below the shoulders 15 on the bottles 12.

It will be appreciated that the geometries and shapes illustrated above are examples only and that the configuration of the device will depend on the actual shape and number of bottles the device is to carry. The illustrated embodiments show a three bottle carrier, but simple modification would result in a carrier for other numbers of bottles.

It may even be desirable to combine the flap 51 of the embodiment shown in FIG. 3 with one of the flaps 34 of the FIG. 1 blank so as to provide reinforcement on both sides of the bottles, or even the flaps 51 of FIG. 5 with those of FIG. 1 to give a combined reinforcement.

Also with some geometries of carrier device and bottle, the handle portions could be dispensed with so as to leave a generally triangular sectioned device.

While a preferred embodiment of the invention has been disclosed in the foregoing specification and drawings, it will be understood by those skilled in the art that variations and modifications thereof can be made without departing from the spirit and scope of the invention, as set forth in the following claims.

I claim:

1. A paperboard carrier device for carrying two or more containers, each container having an annular shoulder with opposed side portions projecting from an upwardly extending neck portion and a cap affixed to each neck portion, said device comprising:

a base having two or more apertures defined therein for receiving the neck portions of the respective containers;

two opposed side walls, each of said side walls being connected to the base along generally parallel fold lines formed along opposite side edges of the base, said side walls being constructed and arranged to be folded along said respective fold lines so that said side walls are angled with respect to the base and extend toward each other;

a cut away portion defined in each said side wall for each respective one of the containers such that the opposed side portions of the annular shoulder on the neck of each respective one of the containers are received between a cooperating pair of said cut away portions in a snap fit; and at least one reinforcing panel hingedly connected to one of said side walls, said reinforcing panel being constructed and arranged to extend between the base and the cut away portion defined in said one of said side walls, said reinforcing panel being constructed and arranged to lie against said one of said side walls and having a maximum length in a direction perpendicular to said fold lines greater than half the width of the base between the fold lines along the opposite side edges of the base.

2. The device as claimed in claim 1 wherein the reinforcing panel for each container is cut from the base to at least partially define said aperture for the container, each of said reinforcing panels being hingedly connected along a hinge formed at the junction of the base and said one of said side walls.

3. The device as claimed in claim 2 wherein one said reinforcing panel is provided for each respective container, each said reinforcing panel having an edge opposite said hinge which extends fully across the aperture in a direction parallel to said hinge.

4. The device as claimed in claim 2 wherein two opposed reinforcing panels are provided for each respective container, each of said opposed reinforcing panels being constructed and arranged to be folded against one each of said respective side walls.

5. The device as claimed in claim 1 wherein the reinforcing panel for each container is cut from the device so as to at least partially define the cut away portions for each respective one of the containers, each reinforcing panel being hingedly connected to its associated side wall.

6. The device as claimed in claim 5 wherein two reinforcing panels are provided for each container, each said reinforcing panel defining said cut away portion for each respective container.

7. The device as claimed in claim 1 wherein each said cut away portion includes an active edge, said active edge of each cut away portion including an edge generally parallel to the junction of the side wall with the base, said edge having generally upwardly angled end portions.

8. The device as claimed in claim 1 wherein the side walls are each hingedly connected to upwardly projecting handle portions which incorporate handle means.

9. The device as claimed in claim 8 wherein each of said cut away portions extends into the handle portions and are sized and shaped to accommodate the caps affixed to the necks of the respective containers.

10. The device as claimed in claim 8 wherein the handle portions are glued together immediately above the hinge line with the side walls.

11. The device as claimed in claim 10 wherein a further securing flap extends from one of said handle portions, said securing flap being sized and shaped to be folded over the free edge of the other handle portion and adhesively secured thereto.

12. The device as claimed in claim 10 wherein a handle is formed in said handle portions by cutting out a slot-shaped element in each said handle portion, which slot-shaped elements remain hingedly connected to each said handle portion along an upper edge which is generally parallel to the hinge between each one of said handle portions and said side walls.

13. The device as claimed in claim 12 wherein the handle is sized and shaped to be folded down so as to lie adjacent one of said side walls, and wherein the slot-shaped elements defined in said handle are sized and shaped to pass over and be received below the annular shoulders of the containers in a snap fit when said handle is folded adjacent said one of said side walls.

* * * * *